United States Patent [19]

Jones et al.

[11] Patent Number: 5,001,984

[45] Date of Patent: Mar. 26, 1991

[54] PROXIMITY FUZE SYSTEM

[75] Inventors: Louis F. Jones; Willis A. Teel, both of Panama City, Fla.

[73] Assignee: The United States of America as represented by the Secretary of the Navy, Washington, D.C.

[21] Appl. No.: 565,317

[22] Filed: Jul. 14, 1966

[51] Int. Cl.[5] ..... F42B 22/04

[52] U.S. Cl. ..... 102/418; 102/211; 102/215; 114/240 R

[58] Field of Search ..... 102/11, 12, 18, 19.2, 102/70.2, 402, 406, 416, 418, 419, 211, 215; 340/16; 342/68

[56] References Cited

U.S. PATENT DOCUMENTS

| | | | |
|---|---|---|---|
| 2,404,440 | 7/1946 | Holm | 102/418 |
| 2,405,694 | 8/1946 | Herzmark | 102/418 |
| 2,979,015 | 4/1961 | Estes | 102/418 |

*Primary Examiner*—Charles T. Jordan

*Attorney, Agent, or Firm*—Sol Sheinbein

[57] ABSTRACT

A proximity fuze system having a plurality of spatially disposed energy detectors, the response patterns of which overlap in such manner as to form an energy response "fence" for detection of an intruding object within a certain area. An explosive charge is also included in the system for disabling or destroying said intruding object, and a plurality of memories and gates are effectively connected between said detectors and explosive charge to effect the detonation thereof whenever said object is within such lethal range as to be sensed by predetermined pairs of said detectors.

11 Claims, 2 Drawing Sheets

PROXIMITY FUZE SYSTEM

The invention described herein may be manufactured and used by or for the Government of the United States of America for governmental purposes without the payment of any royalties thereon or therefor.

The present invention relates generally to proximity fuzes, and in particular, it is an improved method and means for protecting ships, submarine vehicles, and various underwater or other installations from clandestine approach and/or attacks by torpedoes, missiles, submarine boats, swimmers, or any other possibly deleterious intruding vehicles or objects.

Numerous prior art devices have been invented for the purpose of accomplishing similar results, and although many have been satisfactory for some particular purpose, most have had some undesirable characteristics which leave something to be desired. For example, explosive barriers in the form of line charges have been towed beneath the surface of the sea as protection for ships, etc., against attack by torpedoes or the like. At such times, they have been maintained along substantially a horizontal straight line parallel to the length and course of the ship being protected by means of static and dynamic forces which exist as a result of design configuration and drag due to towing. Additionally, such line charges have ordinarily employed passive acoustic proximity fuzes, either located internally or externally with respect to the charge or its housing. However, it has been found that fuzes located internally within the charge or charges have in the past required that their orientations be stabilized by gravity in order to achieve proper charge detonation timing, so as to effect substantially optimum destruction of the attacking vehicle. Fuzes located externally make it necessary to use a more extensive deployment of equipment in order to avoid the necessity for directivity stabilization thereof, and, furthermore, such fuzes usually operate with questionable timing reliability, due to the wide range of acoustic noise which emanate from approaching torpedoes.

The present invention overcomes many of the disadvantages of the prior art in that it does not require gravity stabilization, it permits unlimited rotation of the explosive charge about its axis, and its detonation is effected at such time when the attacking torpedo or other intruding object having a wide band of acoustic noise output is located within the most lethal distance from the explosive charge, regardless of its approach direction and running course.

It is, therefore, an object of this invention to provide an improved proximity fuze-explosive charge combination.

Another object of this invention is to provide an improved method and means for protecting ships, submarine boats, or other underwater objects or installations from clandestine attacks by torpedoes, missiles, submarine boats, or any other enemy vehicles or agents.

Still another object of this invention is to provide an improved method and means for detonating an explosive charge when and only when an approaching enemy target or vehicle is within lethal range or optimum damaging distance thereof.

A further object of this invention is to provide an improved defensive explosive barrier which may be used to protect any predetermined area from intrusion by unwanted persons or objects.

Other objects and many of the attendant advantages will be readily appreciated as the subject invention becomes better understood by reference to the following detailed description when considered in conjunction with the accompanying drawing wherein.

Figure 1:
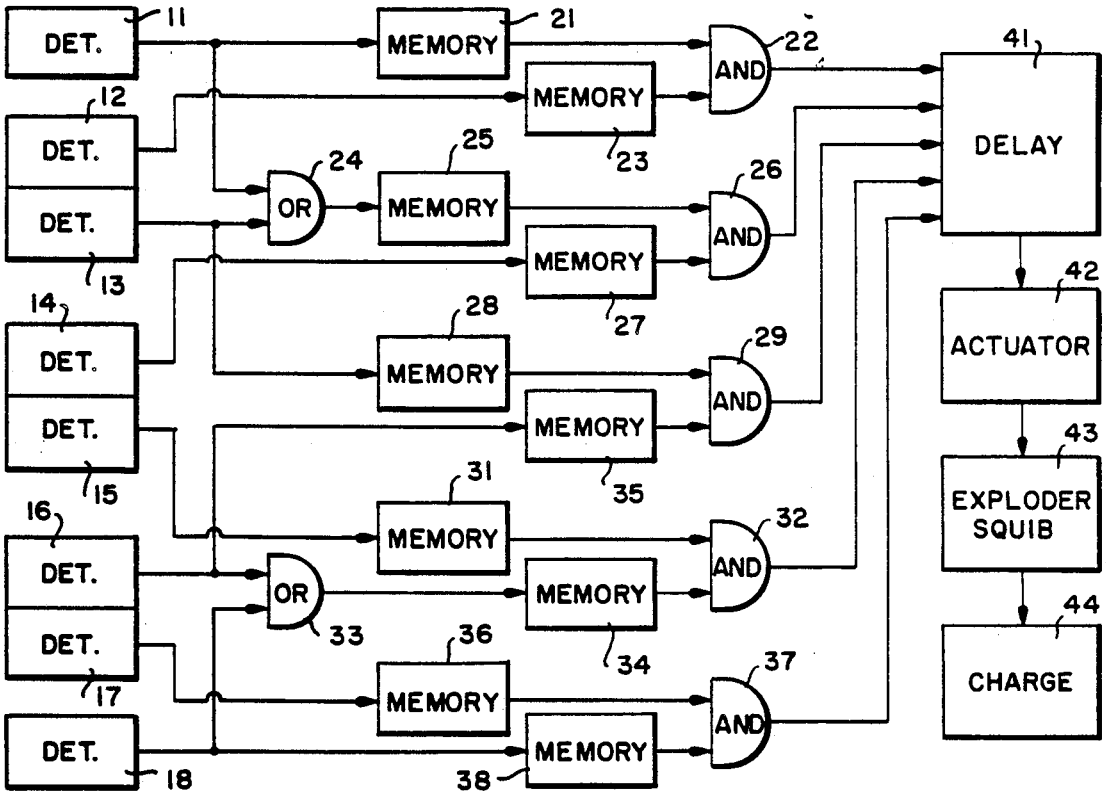
FIG. 1 is a block diagram of the subject invention.

Referring now to FIG. 1, the operational logic of the subject invention is shown in block diagram form as including a plurality of detectors 11 through 18, each of which is disclosed more fully in FIG. 2 and, hence, will be discussed subsequently in connection therewith.

The output of detector 11 is coupled to the input of a memory 21, with the output thereof connected to one of the inputs of an AND gate 22. Detector 12, likewise, has its output coupled to the input of a memory 23 which, in turn, has its output connected to the other input of said AND gate 22. Detector 13 has its output connected to one of the inputs of an OR circuit 24, and, as may readily be seen, the other input to said OR circuit 24 is connected to the output of the aforesaid detector 11. The output of OR circuit 24 is then connected to the input of a memory 25, the output of which is connected to one of the inputs of an AND gate 26. Detector 13 also has its output connected to a memory 28, the output of which is connected to one of the inputs of an AND gate 29. Detector 14 has its output connected to the input of a memory 27, which, in turn, has its output connected to the other input of the aforesaid AND gate 26. Detector 15 has its output connected to the input of a memory 31, with the output thereof connected to one of the inputs of an AND gate 32. Detector 16 has its output connected to one of the inputs of an OR circuit 33, with the output thereof connected to the input of a memory 34, which, in turn, has its output connected to the other input of the aforesaid AND gate 32. Detector 16, likewise, has its output connected to the input of a memory 35, with the output thereof connected to the other input of the aforesaid AND gate 29. Detector 17 has its output connected to the input of a memory 36, the output of which is connected to the input of an AND gate 37. Detector 18 has its output connected to the other input of the aforementioned OR circuit 33 and to the input of a memory 38, the output of which is connected to the other input of said AND gate 37.

Although many well known and conventional memory circuits are commercially available which may be incorporated as each of the memories of FIG. 1, it has been found that monostable multivibrators having proper unstable time periods designed therein may be used as such memory circuits.

The outputs of each of AND gates 22, 26, 29, 32, and 37 are supplied to the inputs of a delay circuit 41. The output of delay 41 is then applied to the input of an actuator 42, the output of which is connected to the input of an exploder squib 43 which, in turn, is suitably connected to an explosive charge 44, which may be, for example, TNT or the like. Of course, actuator 42, squib 43, and charge 44, constitute a typical explosive train and, consequently, if so desired, any other appropriate explosive train may be substituted therefor, as warranted by operational circumstances.

As mentioned above, the device of FIG. 2 is of the type which may be advantageously substituted for each of detectors 11 through 18 of the device of FIG. 1. Hence, said detectors each include a pair of electro-acoustical transducers 51 and 52, the outputs of which are coupled through a pair of adjustable thresholders 53 and 54 to the inputs of a pair of variable gain amplifiers 55 and 56, respectively. The outputs of amplifiers 55 and 56 are coupled to the inputs of a variable potential difference circuit 57 and to a pair of the inputs of an AND gate 58. The output of variable potential difference circuit 57 is connected to the third input of the aforesaid AND gate 58. The output of AND gate 58, of course, constitutes the output of the detector circuit.

Figure 2:
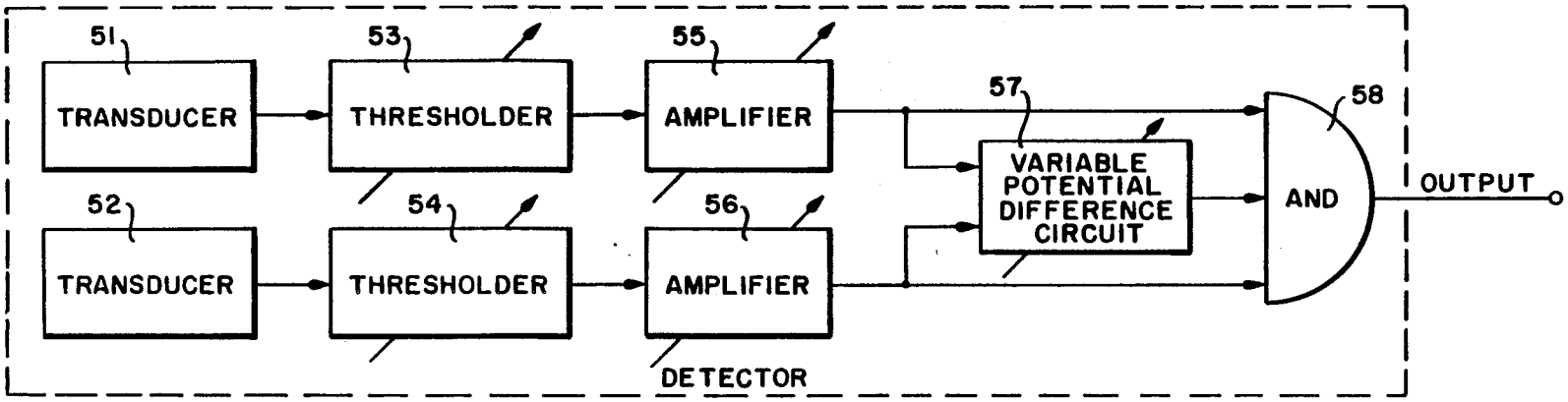
FIG. 2 is a representative block diagram of a detector which may be used as each of the detectors depicted in the device of FIG. 1.

The detector shown herein in FIG. 2 is substantially similar to the detector circuit disclosed in patent application Ser. No. 547717, entitled Target Detector, filed May 3, 1966 by Willis A. Teel and Louis F. Jones, Navy Case No. 42,118. Accordingly, variable potential difference circuit 57 of this case may be constructed in a manner similar to the way it was constructed in the aforesaid patent application, or in any other manner which will produce an output signal therefrom whenever a pair of signals having a predetermined potential difference is applied as the input thereto.

Figure 3:
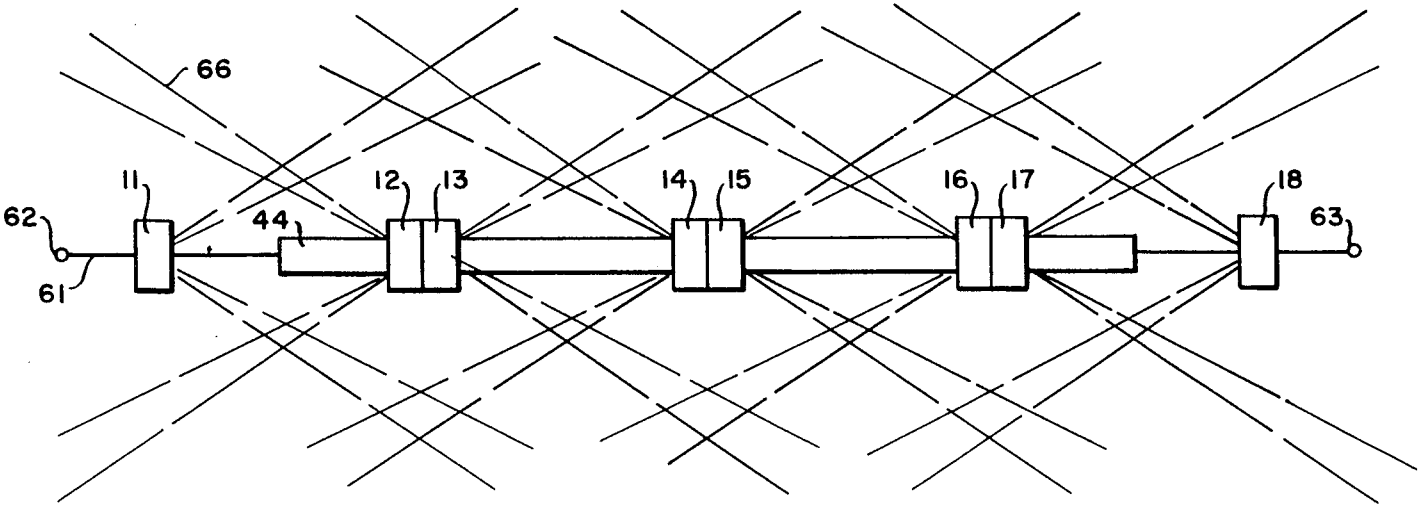
FIG. 3 illustrates in diagrammatical form a complete protective system incorporating the inventive concept and disposed in such manner as to show typical response patterns of the proximity fuze acoustical elements.

FIG. 3 illustrates the combination line charge and proximity fuze with the fuze portion preferably disposed within the line in any convenient manner. Accordingly, the various detector units 11 through 18 are indicated, while the rest of the system circuitry is not.

The entire apparatus is mounted on a cable 61 that is capable of carrying the physical load involved. At opposite ends of cable 61, there are located connectors 62 and 63 which may be any convenient, conventional types that enable the cable to be supported in some predetermined disposition (preferably under tension to maintain a straight line configuration) between any suitable support members (not shown). In the alternative, one of said connectors may be connected to any suitable tractor type device, so as to enable the line to be pulled through the sea water alongside a ship in such manner as to provide it protection from torpedoes, as it travels along its course.

Figure 4:
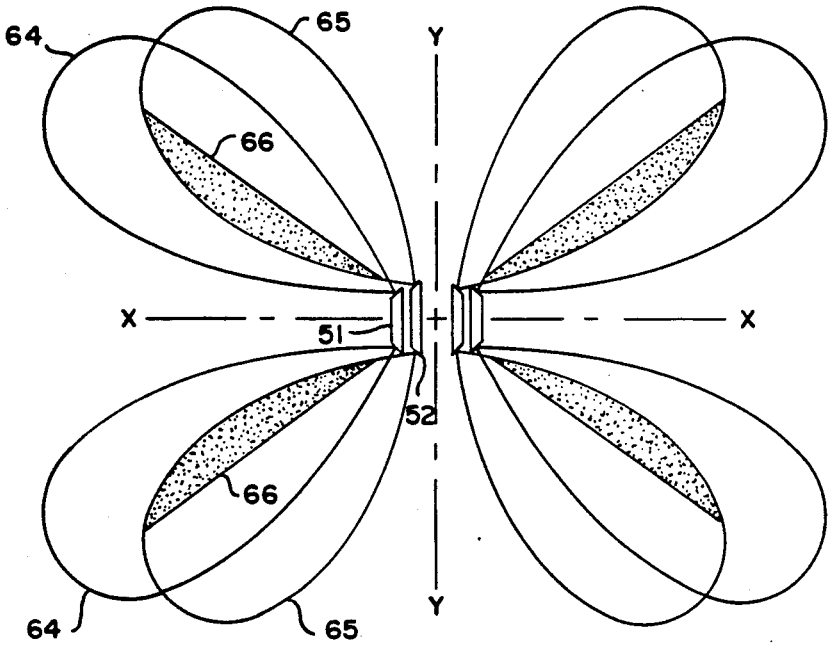
FIG. 4 shows exemplary schematic transducer arrangements which may be employed in the subject invention and the representative receiving response patterns resulting therefrom.

FIG. 4 illustrates schematically how the respective pairs of transducers are disposed in order to obtain the desired reception patterns. For example, the receiving transducers 51 and 52 may be disposed and shaped so as to have the receiving lobes shown; and when the detector amplifiers to which they are attached are properly adjusted from the gain standpoint, response patterns 64 and 65 are effected. Of course, when similar transducers are disposed opposite to transducers 51 and 52, similar but oppositely directed response patterns are obtained.

The operation of the subject invention will not be discussed briefly in conjunction with all of the drawing figures as follows:

FIG. 3 shows line charge 44 with detectors 12 through 17 uniformly spaced along the length thereof and with the remainder of the invention built right into it. And, in this particular preferred embodiment, detectors 11 and 18 are attached to the support cable 61 at positions which are beyond their respective ends of the charge line but at substantially the same distances from their adjacent detectors as their adjacent detectors are from each other. Such positioning of the detectors, thus, makes them uniformly spaced along cable 61 and, hence, they provide a rather uniform three-dimensional response pattern thereabout. Of course, the spacing thereof is merely a matter of design choice and it, therefore, may be varied as desired to suit any given operational circumstances. So doing would obviously be well within the purview of the artisan having the benefit of the teachings herewith presented.

As may readily be seen, detectors 12 and 13, 14 and 15, and 16 and 17 are double detectors which are functionally disposed and, consequently, "look" as those shown in FIG. 4. The end detectors 11 and 18 are single detectors which "look" in the directions indicated. Hence, in this particular configuration, there are four detectors disposed to be polarized or receptive in each of the opposite directions along the longitudinal axis of line charge 44, and when considered as operating in concert, all of said four detectors provide response patterns in all directions extending from said line charge. Hence, the detection zones effected by the subject arrangement are indicated by the dashed lines 66 which extend from all of the detectors, although only one thereof is herewith referenced as such in FIG. 3.

The aforementioned detection zones, in reality, are volumes of revolution which fill the space between pairs of hollow cone-like geometrical configurations, each pair of which has a common axis at a detector, and each volume of revolution between the respective pairs of cones has the same axis as the line charge. FIG. 3 can, thus, be considered as being a sectional view of the three-dimensional conical-surfaced detection zones, with the plane of this section being either horizontal or vertical. Of course, in practice, said plane may also have any other disposition, as long as it includes the longitudinal axis of the line charge.

In order to discriminate against unusually noisy targets which are located beyond the lethal or disabling range, detectors 11 through 18 are operationally interconnected to satisfy two requirements:

(1) that the approaching target must pass through two detection zones of opposite direction within a predetermined period of time; and (2) that the detectors effecting these zones must either be adjacent to one another or in the second detector position from one another.

For example, such discrimination against excessively noisy targets will occur until such time as it penetrates the zones covered by detectors 11 and 12 or 11 and 14, or 13 and 14 or 13 and 16, etc.

The device which satisfies the foregoing requirements and produces the protective type of results mentioned in the objects and otherwise presented above is disclosed in FIG. 1. Of course, as previously mentioned, the device of FIG. 1 includes a plurality of detector devices of the type shown in FIG. 2 which constitute each of detectors 11 through 18 contained therein.

In view of the necessity of combining the devices of FIG. 2 and FIG. 1 to effect the desired results, the operation of the detector of FIG. 2 will now be discussed in some detail, so as to better understand its function in the device of FIG. 1, which will be explained subsequently.

Although the subject invention is primarily intended to deal with underwater targets and the like, it should be understood that it is not limited thereto and accordingly the plurality of detectors incorporated therein may be designed for and used in any appropriate, desired environmental medium, since so doing would merely involve the making of well known design changes that would be well within the purview of one skilled in the art having the benefit of the teachings herewith presented. Therefore, in order to simplify this invention disclosure, the preferred embodiment of the detector disclosed herein will be considered as being combined with the passive sonar type of proximity fuze depicted in FIG. 1.

Transducers 51 and 52 are electroacoustical transducers which are adapted for receiving wave fronts of acoustical energy that emanate from a submarine target that is passing or approaching them. To facilitate determining the direction from which said acoustical energy wave fronts are approaching, transducers 51 and 52 are preferably disposed in such manner along axis X—X of FIG. 4, with said X—X axis being coincident with the longitudinal axis of line charge 44 shown in FIG. 3. When so disposed, the respective response patterns will be essentially as disclosed by lobes 64 and 65 in FIG. 4.

When acoustical energy of some predetermined volume or amplitude is received by transducers 51 and 52, electrical signals are produced thereby which are proportional thereto, and these electrical signals are, in turn, respectively applied to thresholders 53 and 54. Although in this particular embodiment thresholders 53 and 54 are used so as to eliminate any spurious signals not having the aforementioned predetermined amplitudes, it should be considered that they are optional and, therefore, may be deleted from the detectors if so desired, depending upon operational circumstances.

In event the inputs to thresholders 53 and 54 are of sufficient amplitude to pass therethrough, the outputs therefrom are amplified respectively by variable amplifiers 55 and 56 in order to increase the voltage thereof to more useful levels and in order to intentionally make the output voltage level of one greater than that of the other. The characteristics which are effected as a result of so doing may be seen quasi-pictorially by inspection of relative reaches of lobes 64 and 65 of the arrangement depicted in FIG. 4.

In order to generate another signal as a result of the application of some predetermined voltage difference, a variable potential difference circuit 57 is employed. Generation of this signal is effected as a result of subtracting the output voltages from variable gain amplifiers 55 and 56 in such manner that when the voltage difference therebetween exceeds a predetermined voltage, a certain output signal is produced thereby. Although many various and sundry electronics circuit elements may be used for this purpose, the variable potential difference circuit disclosed in the previously referenced patent application is preferably used for this purpose. Hence, the outputs of amplifiers 55 and 56 may actually be applied to a pair of inputs of a subtract circuit, with the output thereof being applied to a Schmitt trigger circuit which, likewise, only produces an output signal if the input thereto is of a sufficient voltage level to overcome the control bias thereof.

The aforementioned difference voltage signal represents a receiving condition which effectively requires that the sound from the approaching target exists within a predetermined location with respect to the receiving transducers; and when this difference signal is generated by variable potential difference circuit 57 at the same time that outputs occur from amplifiers 55 and 56, the approaching sound source will be located somewhere within shaded sectors 66 exemplarily shown in FIG. 4. In other words, when an output signal occurs at amplifier 55, the sonic energy emanating from the approaching target is located somewhere in the direction corresponding to receiving lobe 64; when an output signal occurs at amplifier 56, the sonic energy emanating from the approaching target is located somewhere in the direction corresponding to receiving response lobe 65; and when outputs simultaneously occur at amplifiers 55 and 56 and at variable potential difference circuit 57, the sonic energy from the approaching target (and, thus, the approaching target itself) is located somewhere within the sector corresponding to the shaded area 66 common to both receiving response lobes 64 and 65. This, then, gives an indication of the approximate direction of approach of the approaching underwater target.

The outputs from amplifier 55 and 56 and variable potential difference circuit 57 are all connected to a trio of inputs of AND gate 58 in order to insure that some signal above a zero voltage signal is being processed by both channels of the subject detector. Hence, AND gate 58 insures that the sonic wave fronts are being received by both of the receiving transducers at some predetermined level before the presence of a target is indicated at the output thereof.

The preferred embodiment illustrated in FIG. 1 operates in a relatively simple manner and yet produces an exceedingly useful result. If, for instance, sound from an approaching target is received by any two detectors connected in such manner as to be mutually cooperative, such as, for example, detectors 11 and 12, signals are produced at the outputs thereof which are respectively fed through a pair of memories before being applied to the inputs of an AND gate. If as suggested above, detectors 11 and 12 are used for purposes of illustration, said signals are produced at the output thereof and are then respectively fed through memories 21 and 23 before being applied to the inputs of AND gate 22. Each of said memories 21 and 23, as well as all of the memories disclosed in this case, whether discussed or not, may be any of the well known commercial types which receives an input signal and stores it for a predesigned period of time, after which erasure thereof ordinarily automatically takes place therein. One specific type of design which will fulfill these requirements and, hence, be suitable for use as the memories disclosed herein, is the monostable multivibrator having an unstable period of time that is as long as the memories required for any particular operational circumstances. It would appear to be noteworthy that said memory units are incorporated in the subject invention in order to insure that at least two signals will untimately be applied to AND gate 22 simultaneously, even though the aforementioned sonic energy effectively producing them is received by detectors 11 and 12 at slightly different times. Of course, when the two input signals to AND gate 22 occur at the same time, an output signal is produced thereby which, in turn, is timely delayed, before being applied to actuator 42. Once said signal is applied to actuator 42, it then causes exploder squib 43 to be ignited which, in turn, causes explosive charge 44 to be detonated, as is conventional in the explosive train art.

It has been determined that the aforementioned delay 41 and the particular amount of delay designed therein may be varied according to the operational circumstances effected by the type and speed of the approaching target. If, for example, a ship is defending against an attacking torpedo, the optimum amount of delay used should be such that it would allow the torpedo to run a certain distance toward a more lethal position in proximity with the subject explosive line charge before it is detonated.

As readily seen from the above discussion, the operation of this invention is primarily intended to include the acquiring of an attacking target by two of the indicator units. Hence, the logic of the device disclosed in FIG. 1 is such that this situation will occur and, in event said approaching target is acquired by only one of said detectors, the logic of the device of FIG. 1 will automatically indicate thereto that the approaching target has not yet reached a position where it is susceptible to being either destroyed or disabled by the detonation of the line charge. Therefore, the inadvertent detonation of line charges by running torpedoes not actually constituting a threat to the ship or other objects being defended will not be effected, thereby allowing the subject invention to remain intact in its defensive position until such time as it is usefully expended.

If the approaching sonic energy from an attacking target should arrive from such a direction that it is received, for example, by indicators 11 and 14, a somewhat different signal processing takes place in the device of FIG. 1, although the results produced thereby are substantially similar to those mentioned above. In this particular case, when detector 11 receives the incoming sonic energy, it is applied to OR gate 24, and after passing therethrough it is then applied to memory 25 for timely storage therein, during which time it is applied to one of the inputs of AND gate 26. Likewise, upon receipt of sonic energy by detector 14, a signal is supplied to memory 27 which, in turn, supplies an input signal to the other input of AND gate 26 for the time period designed into memory 27. Like AND gate 22, when the two inputs arrive at AND gate 26 simultaneously, it produces an output signal which is applied to delay 41 for timely passage thereof to actuator 42 which, in turn, actuates exploder squib 43 and charge 44 to effect detonation of the latter.

It would appear to be noteworthy at this time that the incorporation of OR circuit 24 (discussed above) and OR circuit 33 in the subject invention provides a feature of considerable importance from the standpoint of increasing its destructive effectiveness. In actual operation, they insure that detectors located more than two detector intervals apart will not cooperate to actuate the subject proximity fuze and, thus, detonate the line charge before the approaching target has arrived at a vulnerable location with respect thereto, where it would be close enough to either be destroyed or disabled as a result of the explosion thereof.

For the purpose of keeping this disclosure as simple as possible, only two exemplary pairs of receiving detectors have been discussed above, inasmuch as they are respectively similar to the other types of signal processing that would occur, in event any other appropriate pairs of detectors are energized by a target approaching them within their particular responsive zones. In other words, it should, therefore, be understood that numerous other comparable combinations will function equally well to determine the presence of a sound emanating target in some particular approach zone, depending upon the particular detectors receiving acoustical energy at any particular instant. It would, furthermore, appear to be noteworthy at this time that, although only 8 detectors and their associated proximity fuze channels have been used in the preferred device of this disclosure, as many as are necessary to satisfy any given operational situation may be similarly designed into the subject system without violating the spirit and the scope of the inventive concept embodied therein.

From the foregoing, it may readily be seen that the line charge is detonated when and only when two strategically located, oppositely polarized or directed detector units receive the acoustical energy emanating from an unwanted approaching torpedo or other intruder, and, moreover, that this situation exists only when said torpedo or intruder is located within lethal or disabling range of the line charge defined either by the intersecting boundaries of response patterns of adjacently disposed oppositely directed detectors or by the intersecting boundaries of response patterns of alternately disposed oppositely directed detectors.

For purposes of illustration, the following representative parameter values are presented which will meet the requirements of a particular specific torpedo destruction system:

| | |
|---|---|
| Length of line charge | 180 ft. |
| Diameter of line charge | 3 in. |
| Depth of line charge | 30 ft. |
| Spacing of detectors | 60 ft. |
| Typical torpedo speed | 30-50 kts. |
| Typical torpedo running depth | 10-50 ft. |
| Distance from charge at which target will be detected | 20-35 ft. |
| Delay time | 0.3 sec. |
| Typical distance from charge to target at time of detonation | 5-30 ft. |

Obviously, other modifications and embodiments of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. A proximity fuze system for protecting marine vehicles from attack by a torpedo comprising in combination:

an explosive line charge adapted for being timely disposed between said marine vehicle to be protected and said attacking torpedo and for being detonated in response to an electrical signal applied thereto;

a plurality of detectors, each of which is contiguously disposed with and at predetermined distances along said explosive line charge, and each of which has a predetermined response pattern that envelops a portion of said explosive line charge and is directed toward a substantially identical response pattern of a predetermined adjacent one of the others, for determining the intrusion of a given level of acoustical energy originating at and emanating from said torpedo within a predetermined lethal range of said explosive line charge and for producing electrical output signals in response thereto respectively; and means effectively connected between the outputs of said plurality of detectors for response to the respective electrical signals therefrom and the input of said explosive line charge for supplying said electrical signals thereto to effect detonation thereof whenever the aforesaid given level of acoustical energy originating at and emanating from said torpedo is received by predetermined pairs of said detectors.

2. The device of claim 1 wherein each of said plurality of detectors comprises:

a pair of transducers;

a pair of adjustable thresholders respectively connected to the outputs of said pair of transducers;

a pair of variable amplifiers respectively connected to the outputs of said pair of thresholders;

an AND gate having a trio of inputs and an output, with a pair of said inputs respectively connected to the outputs of said pair of variable amplifiers; and means connected between the respective outputs of said pair of amplifiers and the third input of said AND gate for supplying a signal thereto whenever the potential difference between the outputs of said pair of amplifiers exceeds a predetermined amount above a predetermined reference potential.

3. The device of claim 1 wherein said means effectively connected between the outputs of said plurality of detectors for response to the respective electrical signals therefrom and the input of said explosive line charge for supplying said electrical signal thereto to effect detonation thereof whenever the aforesaid given level of acoustical energy originating at and emanating from said torpedo is received by predetermined pairs of said detectors, comprises:

a like plurality of memories effectively connected to the outputs of said plurality of detectors, respectively; and a plurality of AND gates, each of which has a pair of inputs and an output, with the pairs of inputs thereof respectively connected to the outputs of predetermined pairs of said memories, and with the outputs thereof effectively connected to the input of the aforesaid explosive line charge.

4. The invention according to claim 3 further characterized by an electrical signal delaying means effectively connected between the outputs of said plurality of AND gates and the input to said line charge.

5. A proximity fuze system capable of being disposed in a predetermined environmental medium comprising in combination:

an explosive means, the detonation of which is effected by an electrical signal supplied thereto;

first means contiguously disposed with said explosive means having a predetermined hollow substantially conical response pattern which at least partially envelopes said explosive means for detecting the presence of a predetermined energy and producing a first electrical output signal in response thereto;

second means contiguously disposed with said explosive means having a predetermined hollow substantially conical response pattern oppositely disposed and directed relative to the aforesaid predetermined hollow substantially conical response pattern of said first energy detecting means so as to intersect therewith at the respective relatively larger diametrical sections thereof and envelope that portion of said explosive means enveloped by said first detecting means for detecting the presence of the aforesaid predetermined energy and for producing a second electrical output signal in response thereto; and means connected between the outputs of said first and second energy detecting means and the input of the aforesaid explosive means for the timely supplying of an electrical signal thereto to effect the detonation thereof whenever said predetermined energy is detected by each of the aforesaid energy detecting means within a predetermined time period.

6. The device of claim 5 wherein the explosive means, the detonation of which is effected by an electrical signal supplied thereto comprises:

an actuator;

an exploder squib; and an explosive charge connected to said exploder squib in such manner as to be timely detonated thereby.

7. The device of claim 5 wherein said first and second means for detecting the presence of a predetermined energy and producing an electrical output signal in response thereto is a detector comprising:

a pair of transducers;

a pair of variable amplifiers effectively connected to the outputs of said pair of transducers, respectively;

a variable potential difference circuit having a pair of inputs respectively connected to the outputs of said pair of variable amplifiers and an output; and an AND gate having a trio of inputs and an output, with a pair of the inputs thereof respectively connected to the outputs of said variable amplifiers, and with the other input thereof connected to the output of the aforesaid variable potential difference circuit.

8. A subaqueous proximity fuze system comprising in combination:

means having an input and an output for timely delaying for a predetermined time period an electrical input signal supplied thereto;

an actuator connected to the output of said delay means;

an exploder squib connected to the output of said actuator;

an explosive line charge connected to said exploder squib in such manner as to be timely detonated thereby;

a first detector contiguously disposed with said line charge, said first detector having a substantially conical energy response pattern the longitudinal axis of which coincides with the longitudinal axis of said explosive line charge and the directivity of which is such as to envelope at least a portion thereof;

a second detector contiguously disposed with said explosive line charge at a predetermined distance from said first detector, said second detector having a substantially conical energy response pattern the longitudinal axis of which coincides with the longitudinal axis of said explosive line charge and the directivity of which is such as to envelope that portion thereof enveloped by the substantially conical energy response pattern of said first detector;

a third detector contiguously disposed with said explosive line charge and said second detector, said third detector having a substantially conical energy response pattern the longitudinal axis of which coincides with the longitudinal axis of said explosive line charge and the directivity of which is opposite that of said second detector and which is such as to envelope at least a portion of said explosive line charge;

a fourth detector contiguously disposed with said explosive line charge at a predetermined distance from said third detector, said fourth detector having a substantially conical energy response pattern the longitudinal axis of which coincides with the longitudinal axis of said explosive line charge and the directivity of which is such as to envelope those portions thereof enveloped by the substantially conical energy response patterns of said first and third detectors;

a fifth detector contiguously disposed with said explosive line charge and said fourth detector, said fifth detector having a substantially conical energy response pattern the longitudinal axis of which coincides with the longitudinal axis of said explosive line charge and the directivity of which is opposite that of said fourth detector and which is such as to envelope at least a portion of said explosive line charge;

a sixth detector contiguously disposed with said explosive line charge at a predetermined distance from said fifth detector, said sixth detector having a substantially conical energy response pattern the longitudinal axis of which coincides with the longitudinal axis of said explosive line charge and the directivity of which is such as to envelope those portions thereof enveloped by the substantially conical energy response patterns of said third and fifth detectors;

a seventh detector contiguously disposed with explosive line charge and said sixth detector, said seventh detector having a substantially conical energy response pattern the longitudinal axis of which coincides with the longitudinal axis of said explosive line charge and the directivity of which is opposite that of said sixth detector and which is such as to envelope at least a portion of said explosive line charge;

an eighth detector contiguously disposed with said explosive line charge at a predetermined distance from said seventh detector, said eighth detector having a substantially conical energy response pattern the longitudinal axis of which coincides with the longitudinal axis of said explosive line charge and the directivity of which is such as to envelope those portions thereof enveloped by the substantially conical energy response patterns of said fifth and seventh detectors;

a first memory connected to the output of said first detector;

a second memory connected to the output of said second detector;

a first AND gate having a pair of inputs and an output with the inputs thereof respectively connected to the outputs of said first and second memories and the output thereof connected to the input of the aforesaid delay means;

a first OR circuit having a pair of inputs and an output with the inputs thereof respectively connected to the outputs of said first and third detectors;

a third memory connected to the output of said OR circuit;

a fourth memory connected to the output of said fourth detector;

a second AND gate having a pair of inputs and an output with the inputs thereof respectively connected to the outputs of said third and fourth memories and the output thereof connected to the input of the aforesaid delay means;

a fifth memory connected to the output of said third detector;

a sixth memory connected to the output of said sixth detector;

a third AND gate having a pair of inputs and an output with the inputs thereof respectively connected to the outputs of said fifth and sixth memories and the output thereof connected to the input of the aforesaid delay means;

a seventh memory connected to the output of said fifth detector;

a second OR circuit having a pair of inputs and an output with the inputs thereof respectively connected to the outputs of said sixth and eighth detectors;

an eighth memory connected to the output of said second OR circuit;

a fourth AND gate having a pair of inputs and an output with the inputs thereof respectively connected to the outputs of said seventh and eighth memories and the output thereof connected to the input of the aforesaid delay means;

a ninth memory connected to the output of said seventh detector;

a tenth memory connected to the output of said eighth detector; and a fifth AND gate with a pair of inputs and an output with the inputs thereof respectively connected to the outputs of said ninth and tenth memories and the output thereof connected to the input of the aforesaid delay means.

9. The device of claim 8 wherein each of said eight detectors comprises:

a pair of transducers;

a pair of adjustable thresholders respectively connected to the outputs of said pair of transducers;

a pair of variable amplifiers respectively connected to the outputs of said pair of thresholders;

an AND gate having a trio of inputs and an output, with a pair of said inputs respectively connected to the outputs of said pair of variable amplifiers; and means connected between the respective outputs of said pair of amplifiers and the third input of said AND gate for supplying a signal thereto whenever the potential difference between the outputs of said pair of amplifiers exceeds a predetermined amount above a predetermined reference potential.

10. The invention according to claim 8 further characterized by means effectively connected to said explosive line charge for the disposition thereof in a predetermined geometrical configuration.

11. The device of claim 10 wherein said means effectively connected to said explosive line charge for the disposition thereof in a predetermined geometrical configuration comprises:

a cable extending through said explosive line charge substantially along the longitudinal axis thereof; and means attached to each end of said cable for the connection thereof to a support means.

* * * * *